US007284516B2

(12) United States Patent
Wierl et al.

(10) Patent No.: US 7,284,516 B2
(45) Date of Patent: Oct. 23, 2007

(54) INTERNAL COMBUSTION ENGINE WITH HYDRAULIC DEVICE FOR ADJUSTING THE ROTATION ANGLE OF A CAMSHAFT IN RELATION TO A CRANKSHAFT

(75) Inventors: Ulrich Wierl, Mendorf (DE); Mike Kohrs, Wilthen (DE); Rainer Ottersbach, Aurachtal (DE); Jochen Auchter, Weisendorf (DE); Hermann Wiehl, Herzogenaurach (DE)

(73) Assignee: INA-Schaeffler KG, Herzogenaurach (DE)

( * ) Notice: Subject to any disclaimer, the term of this patent is extended or adjusted under 35 U.S.C. 154(b) by 378 days.

(21) Appl. No.: 11/012,883

(22) Filed: Dec. 15, 2004

(65) Prior Publication Data

US 2005/0155567 A1 Jul. 21, 2005

(30) Foreign Application Priority Data

Dec. 16, 2003 (DE) ..... 103 58 888

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,311,657 B2 * 11/2001 Sugawara et al. ..... 123/90.17
6,418,897 B1 * 7/2002 Urban et al. ..... 123/90.17
6,443,113 B1 * 9/2002 Kanada et al. ..... 123/90.17
6,487,996 B1 * 12/2002 Motz et al. ..... 123/90.17
2001/0027763 A1 10/2001 Simpson et al.

FOREIGN PATENT DOCUMENTS

DE 199 51 390 A1 5/2001
DE 101 48 687 A1 6/2002
DE 101 34 320 A1 1/2003

* cited by examiner

*Primary Examiner*—Thomas Denion
*Assistant Examiner*—Zelalem Eshete
(74) *Attorney, Agent, or Firm*—Henry M. Feiereisen

(57) ABSTRACT

A hydraulic device in an internal combustion engine for adjusting a rotation angle of a camshaft in relation to a crankshaft includes a tubular stator and a rotor connected in fixed rotative engagement with the camshaft and having plural vanes in spaced apart relationship to define pressure chambers on both sides of the vanes. The stator is connected in fixed rotative engagement with a crankshaft-drive timing pulley and constructed to define with the rotor vanes the pressure chambers. The stator is made by a shaping process without material to effect a mass reduction. Pressure medium is supplied to or purged from the pressure chambers to selectively adjust the position of the rotor in relation to the stator and thereby the position of the camshaft in relation to the crankshaft.

24 Claims, 5 Drawing Sheets

INTERNAL COMBUSTION ENGINE WITH HYDRAULIC DEVICE FOR ADJUSTING THE ROTATION ANGLE OF A CAMSHAFT IN RELATION TO A CRANKSHAFT

CROSS-REFERENCES TO RELATED APPLICATIONS

This application claims the priority of German Patent Application, Serial No. 103 58 888.4, filed Dec. 16, 2003, pursuant to 35 U.S.C. 119(a)-(d).

BACKGROUND OF THE INVENTION

The present invention relates, in general, to an internal combustion engine, and more particularly to a hydraulic device of an internal combustion engine to adjust the rotation angle of a camshaft in relation to a crankshaft.

Nothing in the following discussion of the state of the art is to be construed as an admission of prior art.

German patent publication no. DE 101 34 320 A1 describes a hydraulic device for adjusting the phase position of a camshaft in relation to a crankshaft of an internal combustion engine. The device includes a rotor, which is configured in the form of a vane wheel secured to the camshaft and co-rotating therewith in synchronism, and a stator which is closed in fluid-tight manner by an end wall, which forms part of a housing in surrounding relationship to the stator, and by a timing pulley, which is driven by the crankshaft. The stator surrounds the rotor and rotates in synchronism with the timing pulley. Substantially radially extending sidewalls in the stator permit only a limited rotation angle of the rotor and form with the stator several pressure chambers which can be supplied with pressure medium or purged from pressure medium.

The components of this hydraulic device are made predominantly of steel or iron through sintering or material removing machining processes. As a result, the hydraulic device is very massive. In addition, manufacturing costs for making the sintered components by the material removal process are extensive, and undesired external oil leaks can be experienced as a consequence of the porosity of the sintered components.

Another reason for making the components of hydraulic devices heavy and massive is the belief that thin wall thicknesses in sintering metallurgy would cause problems as far as density distribution, strength and stiffness are concerned, especially when the wall thickness fluctuates, and that complex shapes with different fill heights can normally be realized only by using expensive slides in the tool. Hydraulic devices made by a material removing process encounter similar problems. In other words, complex shapes to suit the load at hand can be made only by a complicated machining process.

One approach to reduce the mass of the hydraulic device involves the manufacture of components of the hydraulic device from aluminum or aluminum alloy or a different lightweight metal. Examples for this approach include German patent publication nos. DE 101 48 687 A1 or DE 101 34 320. This approach has, however, the drawback that the leakage gap increases in view of the presence of different thermal expansion coefficients when the components heat up, resulting in excessive leaking. Moreover, aluminum is subjected to greater deformation than steel or iron under load when same dimensions are involved. In particular, the use of screw fasteners to bolt the individual parts together requires the provision of large enough gaps to accommodate the deformation. The need for screw fasteners, however, not only also complicates the assembly and incurs added costs but also adversely affects the force flux.

It would therefore be desirable and advantageous to provide an improved device of an internal combustion engine for adjusting the rotation angle of a camshaft in relation to a crankshaft, to obviate prior art shortcomings and to accomplish an overall mass reduction while effectively minimizing leakage.

SUMMARY OF THE INVENTION

According to one aspect of the present invention, in an internal combustion engine, a hydraulic device for adjusting an angle of rotation of a camshaft in relation to a crankshaft includes a rotor connected in fixed rotative engagement with the camshaft and having plural vanes in spaced apart relationship to define pressure chambers on both sides of the vanes, a stator connected in fixed rotative engagement with a crankshaft-driven timing pulley and having a substantially cylindrical outer contour, wherein the stator has an end wall and includes sidewalls, circumferential inner walls and circumferential outer walls in concentric relationship, with the pressure chambers being demarcated by the sidewalls and the outer walls of the segments, wherein the sidewalls, inner walls and outer walls are made without material removal from a sheet metal part, and a hydraulic system is provided for feeding pressure medium to or purging pressure medium from the pressure chambers.

The present invention thus resolves prior art problems by replacing massive sintered components with thin-walled sheet metal parts for demarcating the pressure chambers on the driving side. It is to be understood by persons skilled in the art that the term "sheet metal" is used here in a generic sense and the principles described in the following description with respect to sheet metal are equally applicable to other materials such as band material which generally follows the concepts outlined here. For convenience and sake of simplicity, the following description refers only to sheet metal.

The number of sintered components being produced is thus decreased while the material removal process is simplified and the risk of external oil leaks is reduced as a result of the absence of porous sintered parts.

In order to provide the hydraulic device with the necessary stiffness and load-bearing capability despite the lower mass, the thin-walled sheet metal parts can be locally shaped with dimples or profiled along load directions such as to best suit encountered loads, so that there is no need for providing greater wall thicknesses and to accept resultant higher mass. The reduction in mass in accordance with the present invention can thus be realized without encountering different thermal expansion coefficients of components so that leakage due to thermal effects cannot take place.

According to another feature of the present invention, the sidewalls of the stator interconnect the two ends of neighboring inner and outer walls and extend substantially radially. As an alternative, rather than extend precisely radially, the sidewalls of the stator may also extend at an angle to the radial or it is even conceivable to construct the sidewalls uneven, i.e. not flat, so as to have depressions in order to prevent a jamming of the rotor vanes in their end positions.

As the stator is made of thin-walled sheet metal, it may be less dimensionally stable compared to a sintered stator. Optionally, the stator may therefore be attached directly via a material union to a torque transferring component, i.e. the timing pulley. In order to realize a sufficient bending strength or compressive strength, the stator may be received in a surrounding housing which can be secured to the timing pulley by any connection technique at the disposal to an artisan. Examples include knurling, collaring, welding, swaging, riveting, gluing, and inwardly turned locking lugs. The housing assumes hereby the attachment of the stator to the timing pulley to transmit torque and to transmit radial loads, and also assumes a sealing function. In addition, the housing prevents the occurrence of vibrations as a result of introduced radial forces.

The housing seals the stator on one end surface to form an end wall. In the absence of a right angle between the stator walls and the end wall, there is no assurance of a complete sealing of the pressure chambers. Therefore, in order to prevent leaks, a circular ring shaped sealing disk or washer may be placed directly anteriorly of the end wall so as to realize right-angled pressure chambers after connecting the end wall with the stator and installation of the rotor with the vanes. Stability of the housing may be further enhanced by firmly securing the washer to the end wall. The washer may be made of profiled thin-walled sheet metal and contoured to conform to size and shape of the stator.

The union of the components stator, housing, and washer, can be ensured by any of the afore-mentioned connections techniques. Thus, compressive deformation can be reduced compared to axial, force-locking bolted connection, and moreover, the assembly is simplified by the absence of an added component.

According to another feature of the present invention, all stator components that are made by a non-cutting process can be formed from sheet metal strips. In order to produce a stator, the sheet metal strip is formed in one location into a ring shape and firmly connected, e.g. by welding. Although the stator and the housing are manufactured by a non-cutting process, it will be appreciated by persons skilled in the art that machining processes may in certain situations become desirable for finishing works.

Another option to enhance bending strength and compressive strength of the stator involves the construction of the sidewalls such as to allow a transfer of radial forces and/or circumferential forces. The support of the radial chain or belt force may be realized internally between stator and rotor, or also externally between camshaft, or a prolongation of the rotor, and chain wheel, or a combination of both. Suitably, the sidewalls are constructed at an angle of 10° to 30° in relation to the radial so that the rotor vanes are able to touch the radially outer sidewall ends in their end positions.

According to another feature of the present invention, the stator has a tubular configuration, with the sidewalls being drawn inwards. Thus, the remaining closed ring surface can assume the function of the housing so that the need for a separate housing is eliminated and the overall mass is further reduced. The washer may be positioned between edge and the radial sidewalls, whereby the edge is then sealed and securely connected. In this embodiment, the ring surface absorbs the radial forces and prevents oscillation of the stator.

In order to improve shaping capability, the radial sidewalls may be open and sliding shoes may be used for support and sealing in the rotor. The sliding shoes are so configured and arranged as to mutually support the inwardly drawn sidewalls and thereby prevent the sidewalls from undergoing a bending.

Spaces defined between the sidewalls, such as hollows or cutouts, may be filled by injecting plastic or by metal foam. As a result, the substantially radial sidewalls are further stiffened and the pressure chambers are properly sealed from one another and from the outside.

According to another feature of the present invention, an angle limitation unit may be provided to restrict the rotation angle of the rotor. In this way, the wall thickness of the sidewalls of the stator can further be reduced by preventing the vanes of the rotor to impact the sidewalls in their respective end positions and thereby apply pressure. The angle limitation unit may be realized by forming the rotor with a pin for engagement in a corresponding slotted guide of the timing pulley.

A hydraulic device according to the present invention is lightweight and easier to manufacture (less material removal) as a result of a decreased number of components so that manufacturing costs are reduced and the assembly is simplified. The need for previously required impregnation with synthetic resin or vapor treatment for sealing sintered material is eliminated as provision of sintered material is no longer required.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
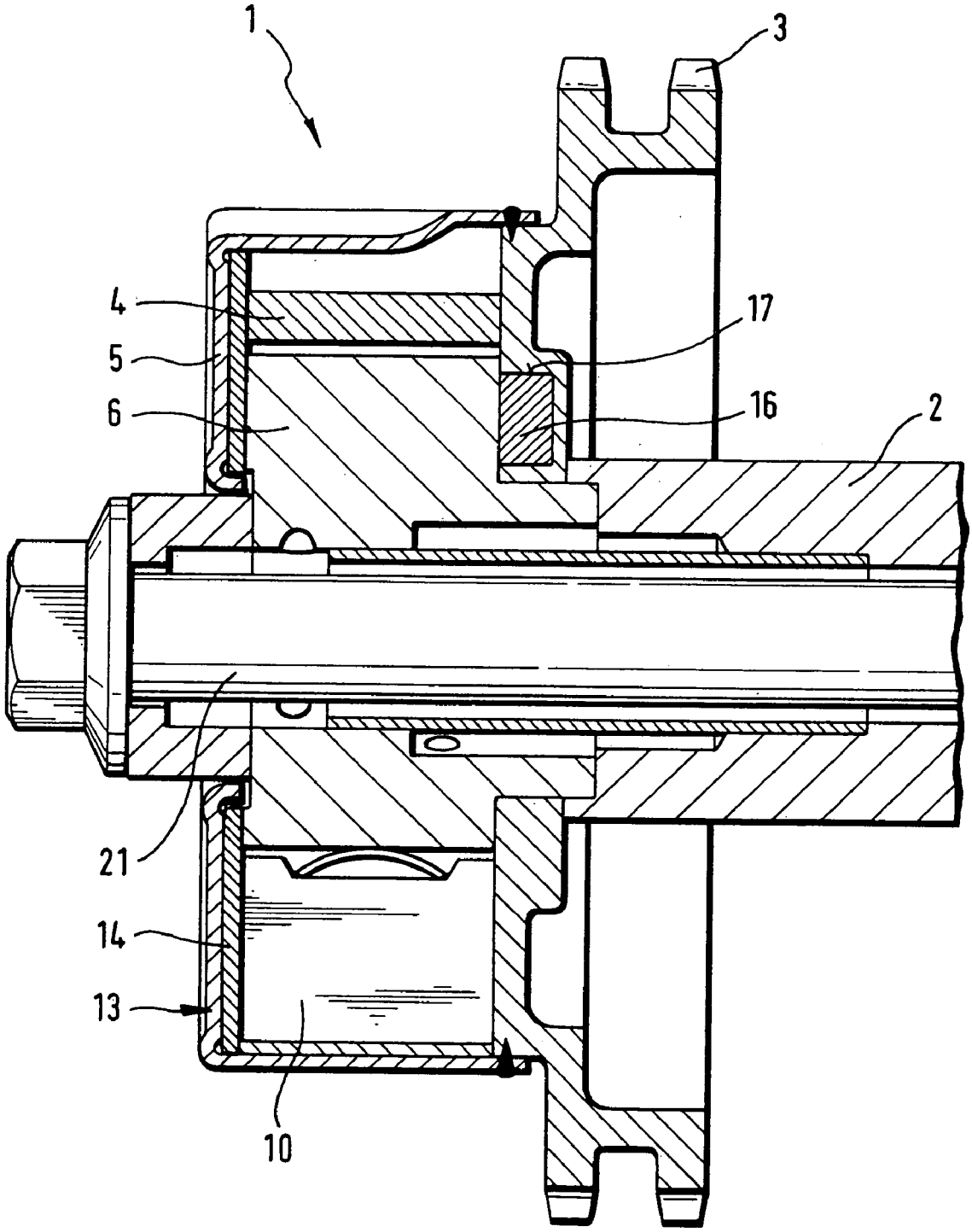
FIG. 1 is a longitudinal section of a first embodiment of a device for rotation angle adjustment according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

This is one of two applications both filed on the same day. Both applications deal with related inventions. They are commonly owned and have the different inventive entity.

Both applications are unique, but incorporate the other by reference. Accordingly, the following U.S. patent application is hereby expressly incorporated by reference: "INTERNAL COMBUSTION ENGINE WITH HYDRAULIC DEVICE FOR ADJUSTING THE ROTATION ANGLE OF A CAMSHAFT IN RELATION TO A CRANKSHAFT".

Turning now to the drawing, and in particular to FIG. 1, there is shown a longitudinal section of a first embodiment of a hydraulic device according to the present invention, generally designated by reference numeral 1, for adjusting the rotation angle of a camshaft 2 in relation to a crankshaft (not shown). The hydraulic device 1 is implemented as a hydraulic actuator and is operated by a timing pulley 3 which may be connected via a not shown chain to the crankshaft. The hydraulic device 1 includes essentially a stator 4, which is firmly secured to the timing pulley 3, and a rotor 6, which is connected in fixed rotative engagement via an axial central screw 21 to the camshaft 2 and is constructed in the form of a vane wheel having vanes 10. The stator 4 is sealed in a fluid-tight manner by an end wall 5 and the timing pulley 3.

Figure 2:
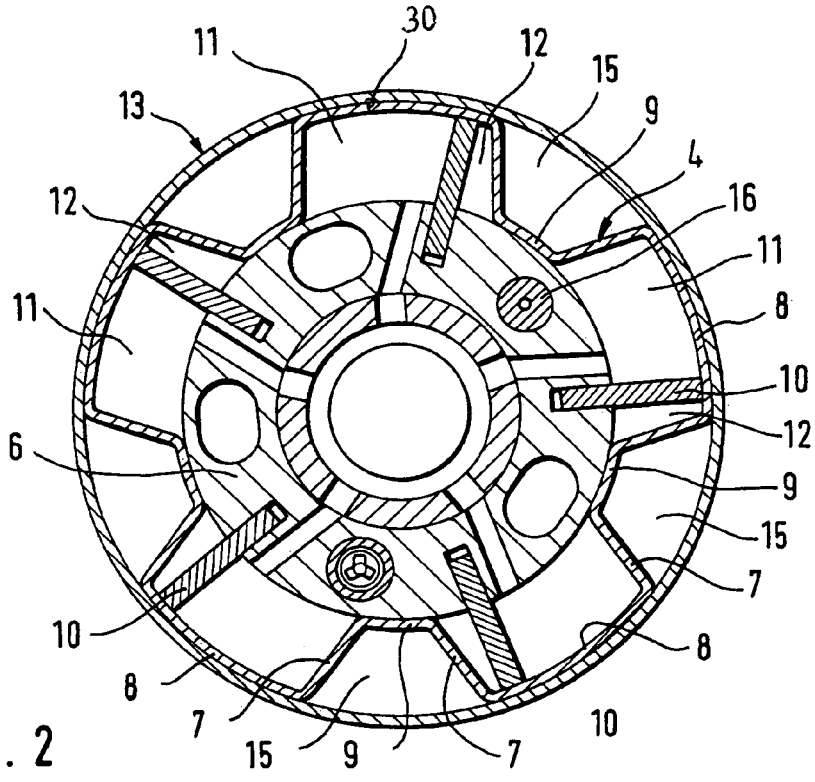
FIG. 2 is a cross sectional view of the device of FIG. 1.

Referring now to FIG. 2, there is shown a cross sectional view of the hydraulic device 1. The stator 4 includes a plurality of circumferential spaced-apart segments which are generally designated by reference numeral 30 and are interconnected by integral inner walls 9 which form a base for cutouts 15 bounded between the segments 30. Each segment 30 includes opposite sidewalls 7 and an outer wall 8 which connects the rotor-distal ends of the sidewalls 7 and extends circumferentially in concentric relationship to the inner walls 9. The vanes 10 of the rotor 6 project out in radial direction and rest against the inside wall surface of the outer walls 8 of the segments 30, thereby subdividing the space, defined by each segment 30 and the rotor 6 and its vanes 10, into a first pressure chamber 11 and a second pressure chamber 12 which can be selectively charged with hydraulic fluid to effect a movement of the rotor 6 in relation to the stator 4 and thus a desired angular position. In other words, the force transfer is such that when the pressure chambers 11, 12 are selectively or simultaneously charged with hydraulic fluid, the rotor 6 undergoes a rotation relative to or is fixed with respect to the stator 4 and the timing pulley 3. This causes the camshaft 2 to rotate likewise in relation to the crankshaft of the internal combustion engine.

The rotor 6 and the stator 4 are arranged in a housing 13 by which the pressure chambers 11 and the pressure chambers 12 are sealed against the outside.

In order to limit the rotation of the rotor 6, a stopper 16 (FIG. 1) in the form of a pin is in connection with the rotor 6 for engagement in a corresponding slotted guide 17 in the form of a circular ring shaped groove in the timing pulley 3. By restricting the rotation of the rotor 6, stress on the stator 4 can be significantly reduced.

The pressure chambers 11 and 12 are further sealed by a sealing disk or washer 14 which is between the housing and the stator 4 and so configured as to conform to the diameter of the stator 4.

As further shown in FIG. 2, the sidewalls 7 are constructed not precisely radially but extend at an angle of about 20°, so that the rotor vanes 10 touch in their end positions the radially outer ends of the sidewalls 7. This enhances the bending strength and compressive strength of the sidewalls 7 and allows transmission of radial forces and circumferential forces.

Figure 3:
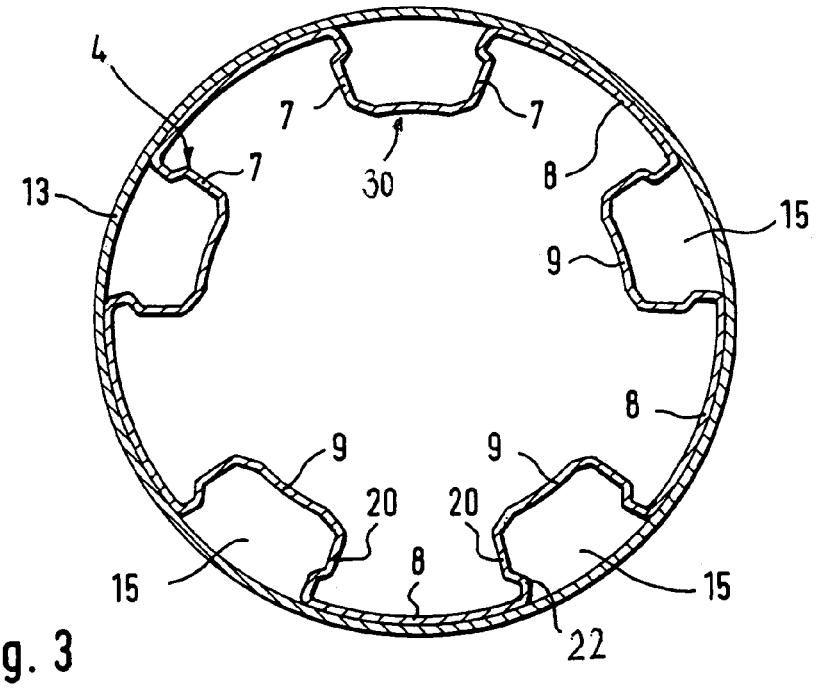
FIG. 3 is a cross sectional view of a modified stator for use in a device for rotation angle adjustment according to the present invention.

Turning now to FIG. 3, there is shown a cross sectional view of a modification of the stator 4 in the form of a tube for use in a device for rotation angle adjustment according to the present invention. Parts corresponding with those in FIG. 2 are denoted by identical reference numerals and not explained again. In this embodiment, the stator 4 with its substantially radially extending sidewalls 7, and the circumferential inner walls 9 and outer walls 8 is received in a cylindrical housing 13 such that the housing 13 and outer walls 8 touch one another to thereby enhance the stiffness of the stator 4 and to realize a damping of radial forces caused by vibrations. Although not shown in detail, the hollows or cutouts 15 formed between the segments 30 and the outer housing 13 may be filled with metal foam.

To prevent a seizing or jamming of the rotor vanes 10 in their end positions, the radial sidewalls 7 may be made of two sections, namely a radial wall section 20 which is intended for impact by the rotor vanes 10 and a further wall section 22 which extends inwardly from the wall section 20.

As further shown in FIG. 3, the inner walls 9 of the stator 4 are slightly arched inwardly.

Figure 4A:
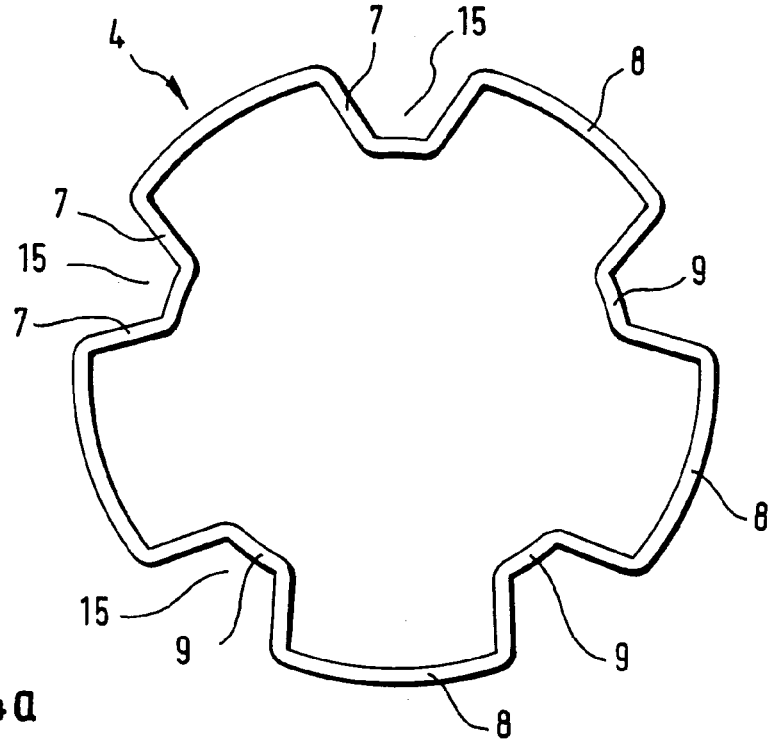
FIG. 4*a* is an elevational view of another variation of a stator for use in a device for rotation angle adjustment according to the present invention.
Figure 4B:
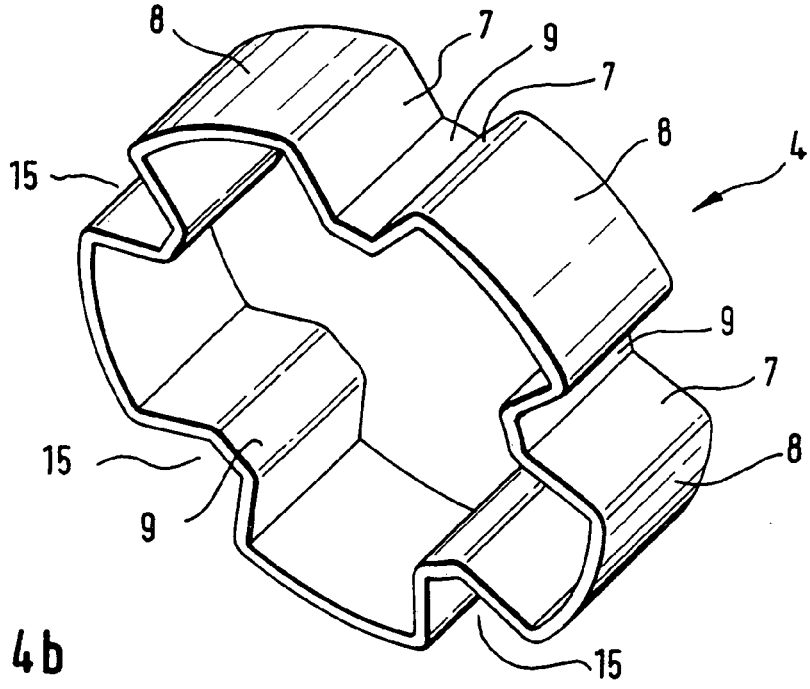
FIG. 4*b* is a perspective view of the stator of FIG. 4*a;*

Turning now to FIGS. 4*a* and 4*b*, there are shown cross sectional and perspective views of another variation of a stator 4 for use in a device for rotation angle adjustment according to the present invention. Again, parts corresponding with those in FIG. 2 are denoted by identical reference numerals and not explained again. In order to better absorb radial forces, the stator 4 of FIGS. 4*a*, 4*b* is constructed stiffer than the stator 4 of FIG. 3 by providing the sidewalls 7 straight, without provision of dimples or bulges shown in FIG. 3 at reference number 22 and representing weak links. The sidewalls 7 are so constructed in radial direction that neighboring sidewalls 7 and the housing 13 (not shown here) prevent a widening (self-locking action) when a radial force is imposed. The outer walls 8 are here slightly outwardly arched and the inner walls 9 are of shorter length compared to the embodiment of FIG. 3.

Figure 5A:
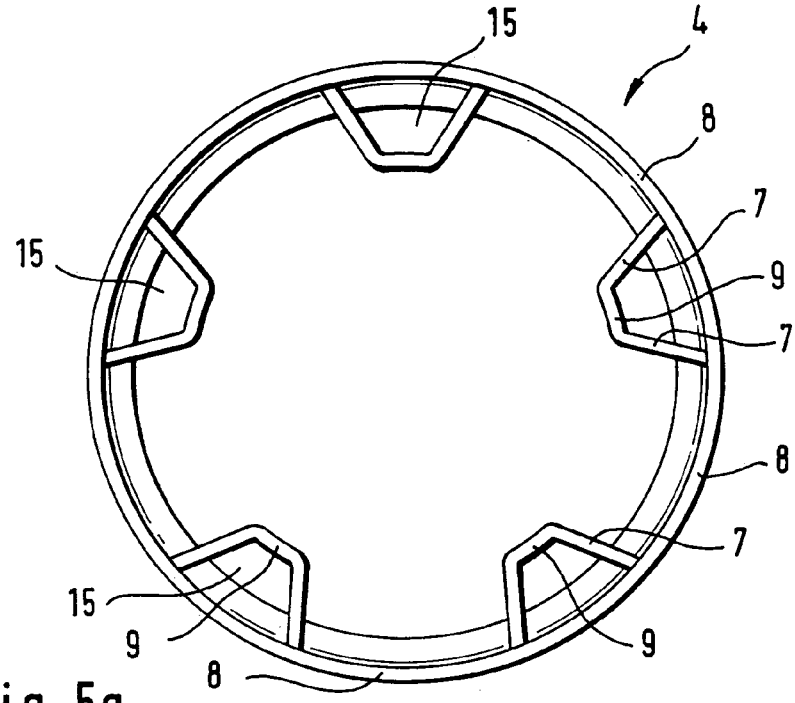
FIG. 5*a* is an elevational view of yet another variation of a stator for use in a device for rotation angle adjustment according to the present invention.
Figure 5B:
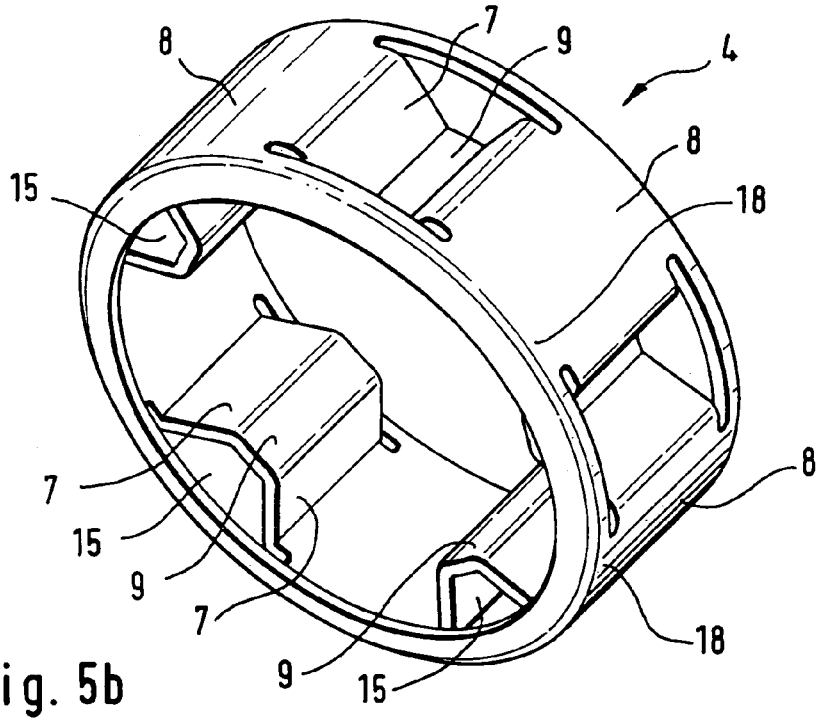
FIG. 5*b* is a perspective view of the stator of FIG. 5*a;*

FIGS. 5*a* and 5*b* show cross sectional and perspective views of yet another variation of a stator 4 for use in a device for rotation angle adjustment according to the present invention. Again, parts corresponding with those in FIG. 2 are denoted by identical reference numerals and not explained again. The description below will center on the differences between the embodiments. In this embodiment, the stator 4 is constructed with an outer wall 8 in the form of an annulus 18, whereby the sidewalls 7 are drawn inwardly and terminate in the inner walls 9. The annulus 18 forms here at the same time an outer housing so that the need for a separate housing, such as housing 13, is eliminated. The sidewalls 7 may be stamped out and then inwardly pushed.

When installing the stator 4 of FIGS. 5*a*, 5*b*, the washer 14 (FIG. 1) is inserted adjacent an end face of the stator 4 and may be used to also form the end wall 5. Suitably, the edge of the washer 14 may be flanged.

Figure 6A:
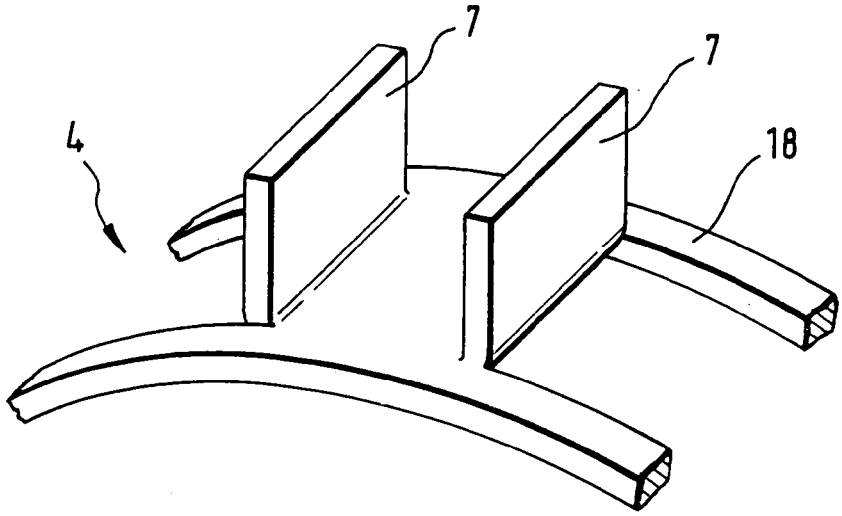
FIG. 6*a* is a detailed cutaway view of a still another variation of a stator, showing a circumferential outer wall with outwardly pointing sidewalls.
Figure 6B:
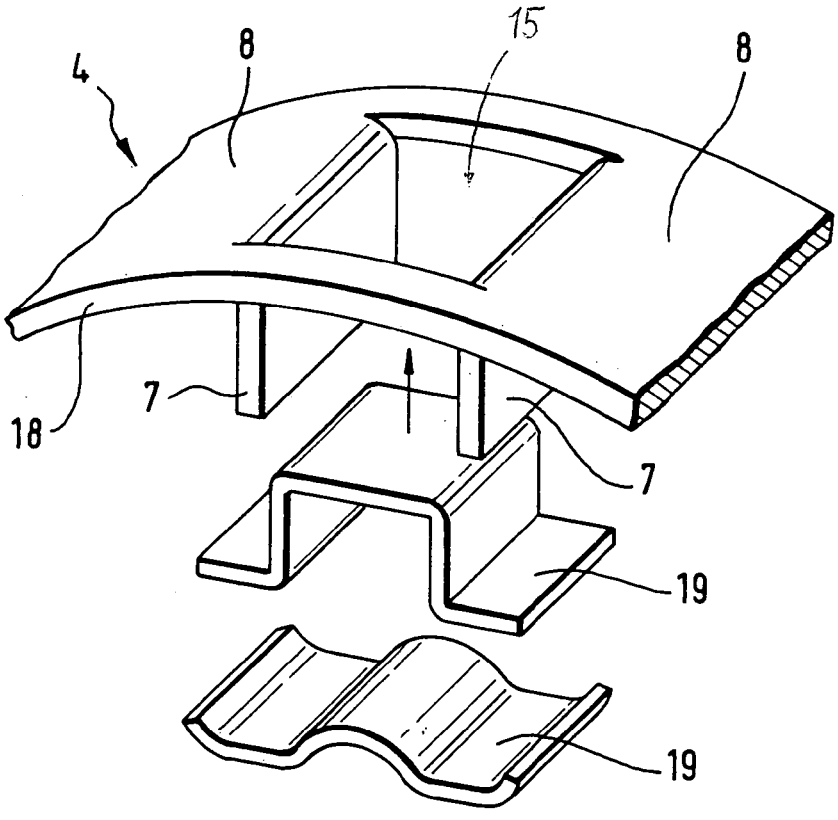
FIG. 6*b* is a detailed cutaway view of a still another variation of a stator, showing a circumferential outer wall with inwardly pointing sidewalls and provision of a sliding shoe.

Turning now to FIG. 6*a*, there is shown a detailed cutaway view of a still another variation of a stator 4, showing a circumferential outer wall 8 (annulus 18) with outwardly pointing substantially parallel sidewalls 7 that have been punched out and bent and remain separate. As a result of the thus-formed open ends, the sidewalls 7 can be easily shaped, as desired. FIG. 6*b* shows an alternative construction, in which the sidewalls 7 are drawn inwardly from the outer wall 8 or annulus 18. Two variations of sliding shows 19 are illustrated here for attachment to the sidewalls 7 to realize a sealing of the pressure chambers (not shown) and to support the sidewalls 7 while preventing a deformation of the sidewalls 7 as a result of imposed external radial forces. The stators 4, shown in FIGS. 6*a*, 6*b*, are received in a housing 13.

Common to all embodiments of the stator 4 is their manufacture from sheet metal through a non-cutting process in a multistage press. This results in less massive components which are stiff enough to be reliable in operation. The risk of leaks is also reduced because of the absence of porous sintered components or need for complicated water vapor treatment of synthetic resin impregnation. When using band material, a sheet metal strip of desired thickness, width and length of e.g. more than 100 meter is used and wound onto a coil which is mounted to a press. The press draws in the band material and cuts pieces of desired length for subsequent production of stators 4 through a non-cutting process, as described above.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

The invention claimed is:

1. In an internal combustion engine, a hydraulic device for adjusting an angle of rotation of a camshaft in relation to a crankshaft comprising:

a rotor connected in fixed rotative engagement with the camshaft and having plural vanes in spaced apart relationship to define pressure chambers on both sides of the vanes;

a stator connected in fixed rotative engagement with a crankshaft-driven timing pulley and having a substantially cylindrical outer contour, said stator having an end wall and including sidewalls, circumferential inner walls and circumferential outer walls in concentric relationship, said pressure chambers being demarcated by the sidewalls and the outer walls of the segments, said sidewalls, inner walls and outer walls being made without material removal from a single band or sheet metal part; and a hydraulic system for feeding pressure medium to or purging pressure medium from the pressure chambers.

2. The hydraulic device of claim 1, wherein the stator has local dimples, embossments, or profiled areas, provided along road directions at locations that are exposed to loads.

3. The hydraulic device of claim 1, wherein the stator has an outer housing constructed as sheet metal part and placed in surrounding circumferential relationship to the sidewalls, inner walls and outer walls.

4. The hydraulic device of claim 3, and further comprising a circular ring shaped washer firmly connected to the end wall and constructed in the form of a sheet metal part for sealing an end face of the pressure chambers, said end wall forming with the outer housing a unitary structure.

5. The hydraulic device of claim 3, wherein the outer housing is tubular.

6. The hydraulic device of claim 1, wherein the stator, the housing and the timing pulley are securely connected to one another.

7. The hydraulic device of claim 6, wherein the stator, the housing and the timing pulley are securely connected to one another by a process selected from the group consisting of knurling, collaring, welding, swaging, riveting, gluing, and inwardly turned locking lugs.

8. The hydraulic device of claim 1, and further comprising a circular ring shaped washer in the form of a sheet metal part for sealing an end face of the pressure chambers.

9. The hydraulic device of claim 1, and further comprising an angle limitation unit for limiting the angle of rotation of the rotor, said angle limitation unit including a pin engageable in a corresponding slotted guide.

10. The hydraulic device of claim 9, wherein the slotted guide is formed in the timing pulley.

11. The hydraulic device of claim 1, wherein the sidewalls are constructed to allow impact of the vanes in their end positions only upon their radially outer end, or upon radially inner end, or upon midsection thereof.

12. The hydraulic device of claim 1, wherein the sidewalls extend at an angle from 10° to 30° in relation to a radial line so that the vanes touch in their end positions only radially outer ends of the sidewalls.

13. The hydraulic device of claim 1, wherein a surface normal upon any surface point of the sidewalls, inner walls and outer walls of the stator extends perpendicular to an axis of the camshaft.

14. In an internal combustion engine, a hydraulic device for adjusting an angle of rotation of a camshaft in relation to a crankshaft comprising:

a rotor connected in fixed rotative engagement with the camshaft and having plural vanes in spaced apart relationship to define pressure chambers on both sides of the vanes;

a stator connected in fixed rotative engagement with a crankshaft-driven timing pulley and having a substantially cylindrical outer contour, said stator having an end wall and including sidewalls, circumferential inner walls and circumferential outer walls in concentric relationship, said pressure chambers being demarcated by the sidewalls and the outer walls of the segments, said sidewalls, inner walls and outer walls being made without material removal from a band or sheet metal part; and a hydraulic system for feeding pressure medium to or purging pressure medium from the pressure chambers, wherein the inner and outer walls alternate in circumferential direction and define sections of a circular cylinder, with neighboring inner and outer walls being connected by the sidewalls which together with the outer walls and the rotor with its vanes bound the pressure chambers and which define hollows or cutouts with their sides distal to the pressure chambers.

15. The hydraulic device of claim 14, wherein the hollows or cutouts are filled with metal foam.

16. The hydraulic device of claim 14, wherein the hollows or cutouts are filled with injected plastic.

17. In an internal combustion engine, a hydraulic device for adjusting an angle of rotation of a camshaft in relation to a crankshaft comprising:

a rotor connected in fixed rotative engagement with the camshaft and having plural vanes in spaced apart relationship to define pressure chambers both sides of the vanes;

a stator connected in fixed rotative engagement with a crankshaft-driven timing pulley and having a substantially cylindrical outer contour, said stator having an end wall and including sidewalls, circumferential inner walls and circumferential outer walls in concentric relationship, said pressure chambers being demarcated by the sidewalls and the outer walls of the segments, said sidewalls, inner walls and outer walls being made without material removal from a band or sheet metal part; and a hydraulic system for feeding pressure medium to or purging pressure medium from the pressure chambers, wherein the sidewalls extend in pairs inwardly or outwardly from a circumferential wall of an outer cylinder or inner cylinder.

18. The hydraulic device of claim 17, wherein the sidewalls are formed by stamping the circumferential wall and bending formed webs in pairs radially outwards or inwards.

19. The hydraulic device of claim 18, and further comprising sliding shoes for connecting and supporting pairs of sidewalls, said sidewalls defining hollows.

20. The hydraulic device of claim 19, wherein the hollows are filled with metal foam.

21. The hydraulic device of claim 19, wherein the hollows are filled with injected plastic.

22. In an internal combustion engine, a hydraulic device for adjusting an angle of rotation of a camshaft in relation to a crankshaft comprising:

a rotor connected in fixed rotative engagement with the camshaft and having plural vanes in spaced apart relationship to define pressure chambers on both sides of the vanes;

a stator connected in fixed rotative engagement with a crankshaft-driven timing pulley and having a substantially cylindrical outer contour, said stator having an end wall and including sidewalls, circumferential inner walls and circumferential outer walls in concentric relationship, said pressure chambers being demarcated by the sidewalls and the outer walls of the segments;

and a hydraulic system for feeding pressure medium to or purging pressure medium from the pressure chambers, wherein the sidewalls and at least one of the inner walls and the outer walls are made without material removal from a single sheet metal part.

23. The hydraulic device of claim 22, and further comprising a circular ring shaped washer in the form of a sheet metal part for sealing an end face of the pressure chambers.

24. The hydraulic device of claim 23, wherein the washer is firmly connected to the end wall, said end wall forming with the outer housing a unitary structure.

* * * * *